US008952632B2

(12) United States Patent
Du et al.

(10) Patent No.: US 8,952,632 B2
(45) Date of Patent: Feb. 10, 2015

(54) DRIVER SYSTEMS FOR DRIVING LIGHT EMITTING DIODES AND ASSOCIATED DRIVING METHODS

(75) Inventors: Lei Du, Hangzhou (CN); Bairen Liu, Hangzhou (CN); Kaiwei Yao, San Jose, CA (US); Junming Zhang, Hangzhou (CN); Yuancheng Ren, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 1002 days.

(21) Appl. No.: 13/048,751

(22) Filed: Mar. 15, 2011

(65) Prior Publication Data

US 2011/0227492 A1 Sep. 22, 2011

(30) Foreign Application Priority Data

Mar. 16, 2010 (CN) ..... 2010 1 0124501

(51) Int. Cl.
*H05B 37/02* (2006.01)
*H05B 33/08* (2006.01)

(52) U.S. Cl.
CPC ..... *H05B 33/0818* (2013.01); *H05B 33/0848* (2013.01)
USPC ..... 315/308; 315/291

(58) Field of Classification Search
USPC ..... 315/185 R, 209 R, 224–226, 270–276, 315/291, 294, 307, 308, 312
See application file for complete search history.

(56) References Cited

U.S. PATENT DOCUMENTS

2008/0136350 A1* 6/2008 Tripathi et al. ..... 315/294
2010/0213857 A1* 8/2010 Fan ..... 315/186

* cited by examiner

*Primary Examiner* — Jimmy Vu
(74) *Attorney, Agent, or Firm* — Perkins Coie LLP

(57) ABSTRACT

LED driver systems and associated methods of control are disclosed herein. In one embodiment, the LED driver system comprises a converter and a controller. The controller is responsive to the LED current feedback signal and a dimming signal, and operable to generate a continuous gate drive signal to control the primary side switch of the converter. Thus, the controller regulates the output current of the converter.

10 Claims, 9 Drawing Sheets

DRIVER SYSTEMS FOR DRIVING LIGHT EMITTING DIODES AND ASSOCIATED DRIVING METHODS

CROSS-REFERENCE TO RELATED APPLICATION(S)

This application claims priority to Chinese Patent Application No. 201010124501.2, filed Mar. 16, 2010, the disclosure of which is incorporated herein by reference in its entirety.

TECHNICAL FIELD

The present technology generally relates to light emitting diode ("LED") power supplies and associated methods of control.

BACKGROUND

White LED strings are widely used as backlight of liquid crystal displays ("LCDs") in computers, televisions, and other electronic devices. Typically, an LED string is powered by a switch-mode driver system. A primary switch device is controlled by a feedback signal which represents the current flowing through the LED string. The term "primary switch" as used herein generally refers to a primary side switch in an isolated converter and to a high-side switch in a non-isolated converter such as a buck converter.

For regulating brightness of an LED string, another switch device is coupled in series with the LED string to function as a dimming switch. FIG. 1 illustrates an operational waveform of a conventional LED driver. The main circuit provides a constant current to the LED string, and the primary switch device is controlled by a pulse width modulation ("PWM") drive signal. As shown in FIG. 1, the PWM dimming signal, as the gate signal of the dimming switch device, regulates the brightness of the LED string by varying the duty cycle. The frequency of the PWM drive signal is higher than that of the PWM dimming signal. When the PWM dimming signal is in a high-level, the dimming switch turns on, and current flows through the LED string. As a result, a signal ILED by which the PWM dimming signal is modulated is in a high level as well. When the PWM dimming signal is in a low-level, the dimming switch turns off, and a current no longer flows through the LED string corresponding to a zero PWM driver signal.

DETAILED DESCRIPTION

Various embodiments of power systems, circuits, and methods of control are described below. Many of the details, dimensions, angles, shapes, and other features shown in the figures are merely illustrative of particular embodiments of the technology. The phrase a "continuous signal" as used hereinafter generally refers to a signal (e.g., a PWM signal), a logic "LOW" period of which does not surpasses one cycle period of an oscillator signal based on which the signal is generated during normal operation. A person skilled in the relevant art will also understand that the technology may have additional embodiments, and that the technology may be practiced without several of the details of the embodiments described below with reference to FIGS. 2-8:

As discussed above, the PWM dimming signal used in conventional LED drivers is a periodic signal. It has been recognized that with this driving technique, an undesired harmonic with a frequency corresponding to the PWM dimming signal may be generated by the primary switch. Such a harmonic may cause ripple noise in the system if not at least suppressed or eliminated.

Embodiments of the present technology can at least reduce the impact of the foregoing undesirable harmonic in an LED driver system. In certain embodiments, the LED driver system comprises a switch-mode voltage converter, a dimming module, and a controller. The voltage converter can comprise a primary switch and an output end configured to supply power to an LED load. The dimming module comprises a dimming switch. The controller is responsive to an external dimming signal and a feedback signal from the output end of the voltage converter, and is operable to generate a continuous PWM drive signal to control the primary switch and a PWM dimming signal to control the dimming switch. Examples of such LED driver systems are described in more detail below with reference to FIGS. 2-8.

Figure 1:
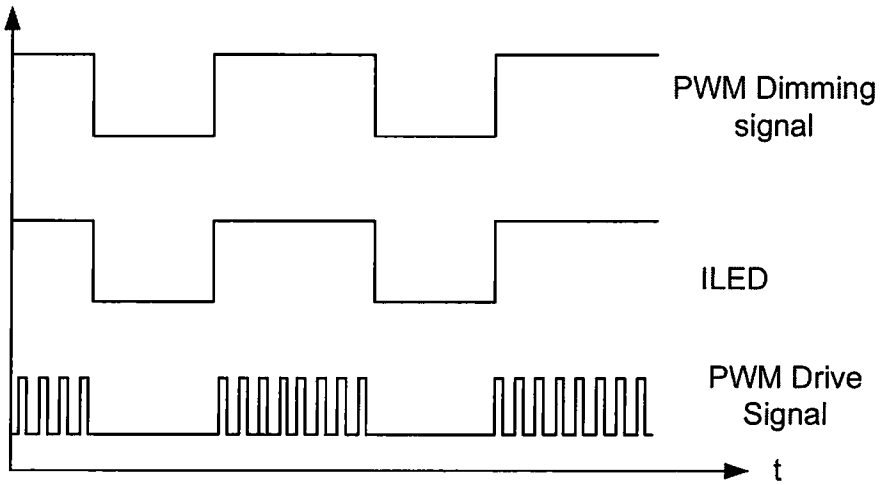
FIG. 1 (Prior Art)
FIG. 1 illustrates a waveform diagram of a conventional LED driver.
Figure 2:
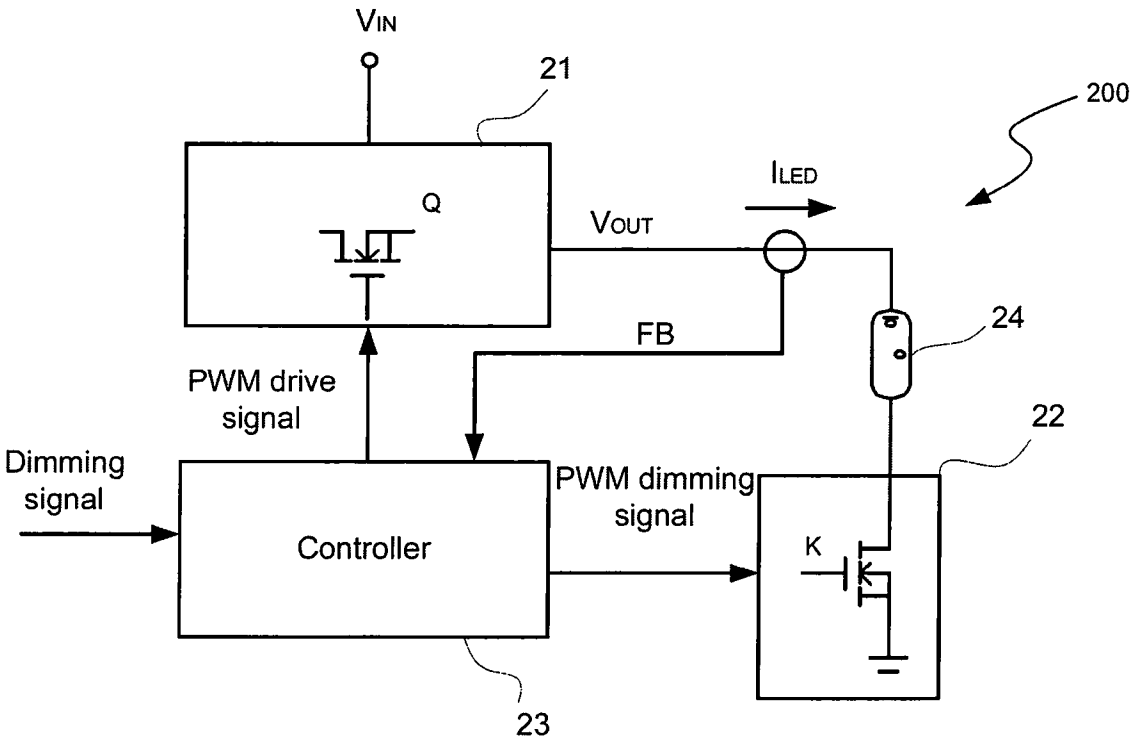
FIG. 2 illustrates an LED driver system according to an embodiment of the present technology.

FIG. 2 illustrates an LED driver system 200 according to an embodiment of the present technology. The LED driver system 200 comprises a switch-mode voltage converter 21, a dimming module 22, and a controller 23. The LED driver system 200 provides power to the LED string 24 as well as provides dimming control for controlling the brightness of the LED string 24. The LED string 24 can include a plurality of LEDs connected in series. However, in other embodiments, the LED driver system 200 can also be coupled to a single LED, an LED array, and/or other types of LED load.

The converter 21 converts an input DC (direct current) voltage $V_{IN}$ into another DC voltage $V_{OUT}$ corresponding to the PWM drive signal from the controller 23. The voltage $V_{OUT}$ is supplied to the LED string 24. The controller 23 receives an external dimming signal and generates a PWM dimming signal to control the dimming module 22. The dimming module 22 comprises a dimming switch K connected in series with the LED string 24. The dimming switch K is controlled by the PWM dimming signal from the controller 23 and regulates the brightness of the LED string 24. The controller 23 further receives an LED current feedback signal FB, and generates a continuous PWM drive signal according to the feedback signal FB and the PWM dimming signal. The feedback signal is proportional to the current $I_{LED}$ flowing through the LED string 24.

Figure 3:
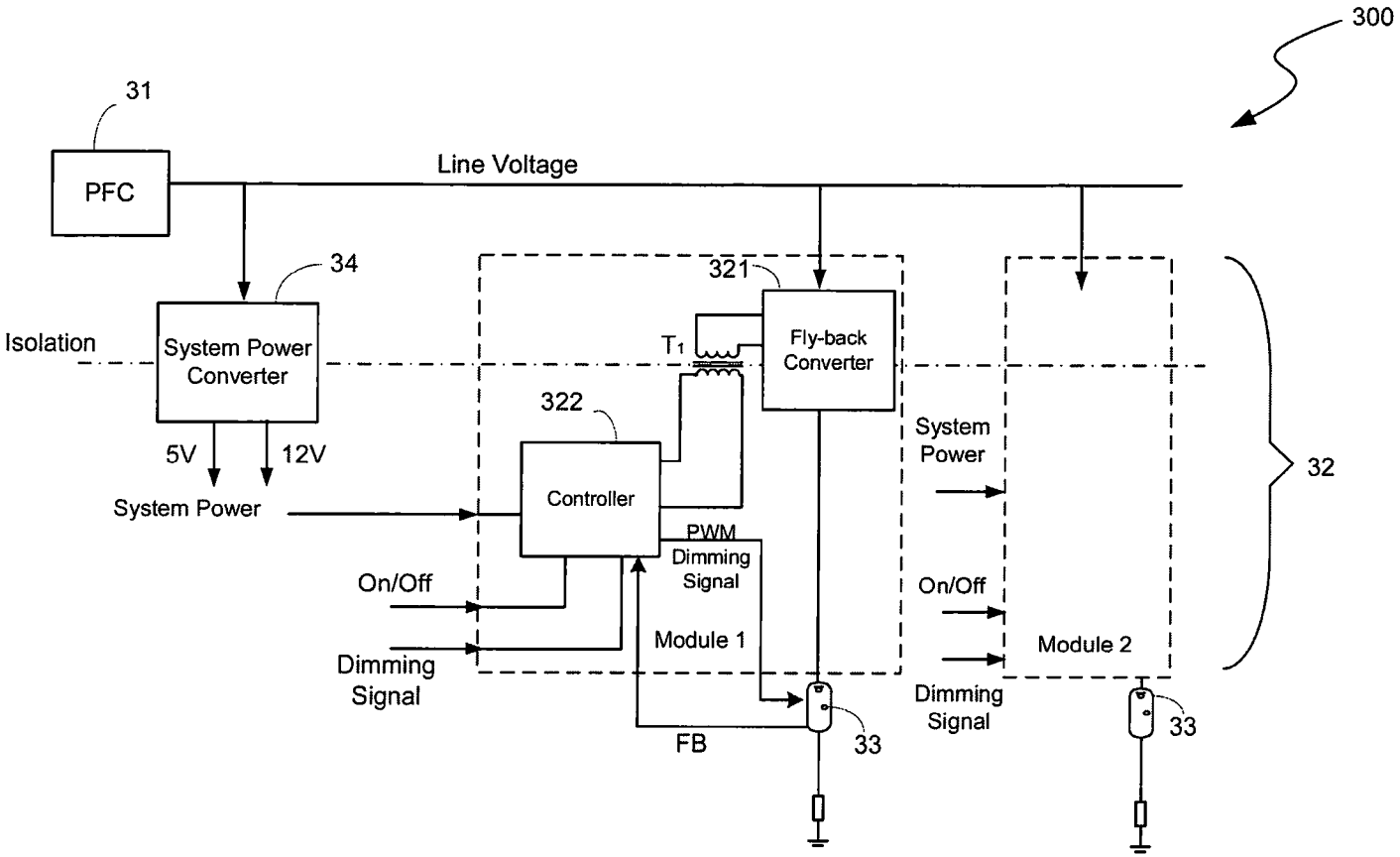
FIG. 3 illustrates an isolated LED driver system according to an embodiment of the present technology.

FIG. 3 illustrates an isolated LED driver system 300 according to an embodiment of the present technology. The LED driver system 300 comprises a PFC stage 31 and an isolated voltage converter driver stage 32. The driver stage 32 includes one or more isolated voltage converter modules (e.g., Module 1, Module 2, etc.). As the power source of an LED string 33, each module comprises a switch-mode isolated voltage converter 321 and a controller 322.

In the illustrated embodiment in FIG. 3, the isolated voltage converter 321 is a fly-back voltage converter though in other embodiments, the isolated voltage converter 321 can also include other suitable types of voltage converter. Receiving dimming signals from external sources (not shown), the controller 322 dims the LED strings 33, and regulates the output voltage of the isolated voltage converter 321 by controlling its primary side switch. The horizontal dash-and-dot line represents the isolation of the isolated voltage converter driver stage. Above the isolation line is the primary side while below the isolation line is the secondary side.

In the illustrated embodiment, the controller 322 is positioned at the secondary side of the isolated voltage converter 321. As a result, the controller 322 delivers the control signals to the primary side of the fly-back voltage converter 321 through an isolated transformer $T_1$. In other embodiments, the controller 322 may transmit the control signals across the isolation line through, for example, optical coupler. A system power converter 34 supplies power (for example, 12V and 5V in FIG. 3) to the controller 322. A fly-back voltage converter is used as the system power converter 34 in the illustrated embodiment. Other external control signals (for example, the on/off signal) may also be inputted into the controller 322 for controlling the operation of the system 300.

Figure 4:
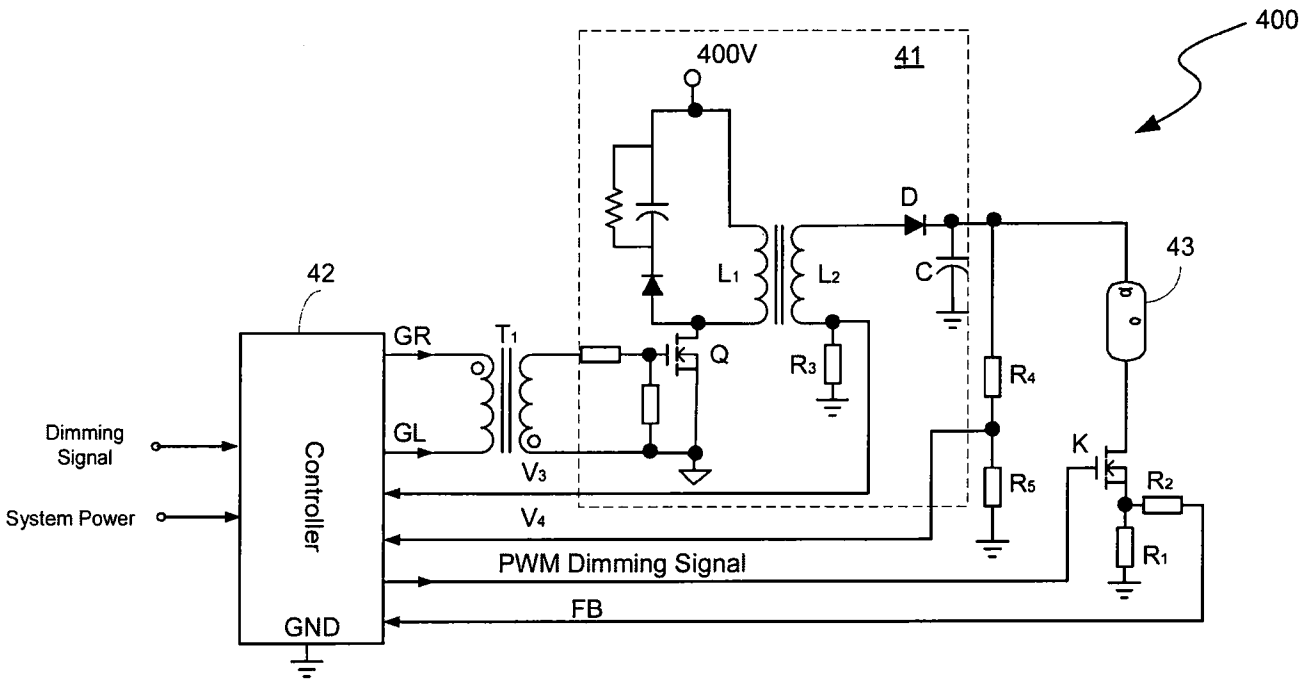
FIG. 4 illustrates an isolated voltage converter driver stage module in accordance with an embodiment of the present technology.

FIG. 4 depicts an isolated voltage converter module 400 of an LED driver system according to an embodiment of the technology. The isolated voltage converter module 400 comprises a fly-back voltage converter 41, a controller 42, and a transformer $T_1$. The primary side of the fly-back voltage converter 41 comprises a primary side winding $L_1$ and a primary side switch Q. The output power of the fly-back voltage converter is regulated by varying the operational duty cycle of the primary side switch Q.

In certain embodiments, the duty cycle of the PWM drive signal to the gate of the primary side switch Q does not fall to zero based on the frequency of the PWM drive signal. Thus, the gate drive signal is a continuous one. For example, during normal operation, for a PWM signal generated based on an oscillator signal with a cycle period of T, if a logic LOW period is substantially more than the period of T, it is not a continuous one. If the logic LOW period of the PWM signal never surpasses T, it is a continuous one. If a signal has a logic LOW period substantially more than the period of T only during abnormal conditions (e.g., during shutting down for protection purpose or during startup), it is still a continuous one. Therefore the periodic low-level state in the prior art described above is avoided, and a low frequency ripple noise may be at least reduced or eliminated.

In the illustrated embodiment, the primary side switch Q is a MOSFET device though other types of switching devices may also be used. The secondary side of the fly-back voltage converter 41 comprises a secondary winding $L_2$, a rectifier D, and a filter capacity C. The LED string 43 is powered by the output of the fly-back voltage converter 41. A dimming switch K is connected in series with an LED string 43 for dimming the brightness of the LED string 43. In the illustrated embodiment, the dimming switch K is a MOSFET though other types of switching devices may also be used.

The controller 42 is responsive to an external dimming signal and operable to generate a PWM dimming signal to control the gate of switch K. As a result, by varying the duty cycle of the PWM dimming signal, the brightness of the LED string 43 can be regulated. The secondary side of the fly-back voltage converter 41 further comprises an LED current feedback circuit that includes a current sense resistance $R_1$ in the illustrated embodiment. One end of $R_1$ is coupled to the source of the switch K. The other end of $R_1$ is coupled to the ground of the secondary side.

The output feedback signal FB formed by $R_1$ is provided to the controller 42. In the illustrated embodiment, the feedback circuit transmits FB signals through another resistance $R_2$. Voltage $V_{FB}$ as the FB signal reflects to the current flowing through the LED string 43 when the dimming switch K is on, $V_{FB}=I_{LED}*R_1$. The controller 42 is responsive to the FB signal and accordingly operable to generate the gate drive signal to the primary side switch Q. As shown in FIG. 4, the controller 42 provides gate drive signals GR and GL to the primary side circuit as a PWM signal via the transformer $T_1$. The PWM signal, equaling or proportional to $V_{GR}$-$V_{GL}$, is provided to the gate of the primary side switch Q in order to regulate its duty cycle. Accordingly the current of LED string 43 can be generally constant. In other embodiments, the controller 42 may also transmit the gate drive signal to the primary side switch Q, for example, by an optical coupler (not shown).

Continuing with FIG. 4, the controller 42 may further provide over-current protection and no-load protection. In the illustrated embodiment, the secondary side winding $L_2$ is in series with resistance $R_3$ while the other end of $R_3$ is connected with the secondary side ground. Voltage $V_3$ corresponded to $R_3$ is provided to the controller 42. When the winding current of secondary side increases, the voltage $V_3$ may surpass a reference value corresponding to over current. The duty cycle of the gate drive signal generated from the controller 42 falls to zero in order to shut down the primary side switch. The voltage on the secondary side filter capacities C, in other words, the output voltage $V_{OUT}$ of the isolated voltage converter 41, is sampled by resistance divider consisted of $R_4$ and $R_5$, thus producing voltage $V_4$ to the controller 42. When the $V_{OUT}$ rises over a reference value because of no-load (the LED load is cut off) or other situations, the duty cycle of the gate drive signal generated from the controller 42 falls to zero. Consequently the primary side switch Q is stopped.

The present technology is not confined to isolated converter systems; non-isolated converters such as buck converters or boost converters may also apply the present technology. For example, for a buck converter, the high-side switch functions as the primary switch driven by a continuous PWM drive signal and the buck converter may be appropriately configured to supply the LED load.

Figure 5A:
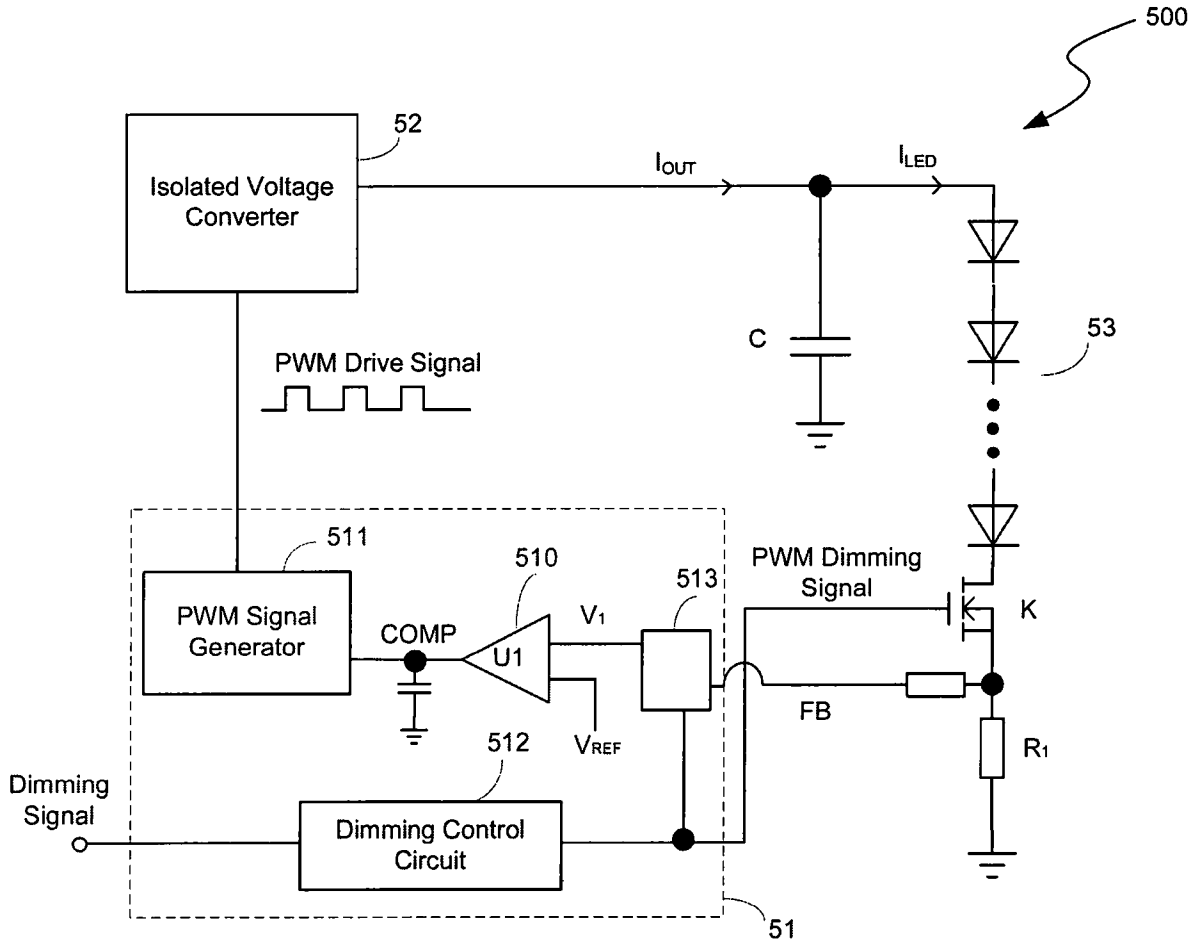
FIG. 5A illustrates a schematic block diagram of a controller according to an embodiment of the present technology.

FIG. 5A illustrates a block diagram of an LED driver system 500 according to an embodiment of the present technology. As shown in FIG. 5A, the controller 51 comprises an error amplifier 510, a PWM signal generator 511, a dimming control circuit 512, and a hold-on circuit 513. A current feedback signal FB of an LED string 53 is sent to the hold-on circuit 513 and thus the hold-on circuit 513 generates a hold-on signal. The error amplifier 510 and the PWM signal generator module is responsive to the hold-on feedback signal, and operable to generate a gate drive signal (PWM drive signal) to the gate of the primary side switch to control its on and off.

The dimming control circuit 512 is responsive to an external dimming signal, and operable to generate a PWM dimming signal to the gate of the dimming switch K. Controlled by the PWM dimming signal, the brightness of the LED string is in proportion to its duty cycle. The current $I_{LED}$ flowing through the LED string 53 is sensed by a current sense resistance $R_1$ as the voltage across $R_1$. Therefore a current feedback signal FB is generated, $V_{FB}=I_{LED}*R_1$. The waveform of FB signal generally corresponds to the PWM dimming signal (consistent duty cycle and frequency) since when the PWM dimming signal is in logic "LOW", the dimming switch K is turned off and current stops flowing through the LED string 53.

In order to obtain a continuous PWM drive signal, the feedback signal FB is generated adopting a hold-on circuit 513. The hold-on circuit 513 generates an output signal V1 according to the FB signal and the PWM dimming signal. When the dimming switch K is on, or in other words, the PWM dimming signal is in high level, the voltage V1 generated by hold-on circuit 513 is in proportion to $V_{FB}$. When the PWM dimming signal is in low level, the voltage V1 is not changed and remains the same value as it was at the end of the preceding high-level PWM dimming signal.

Figure 5B:
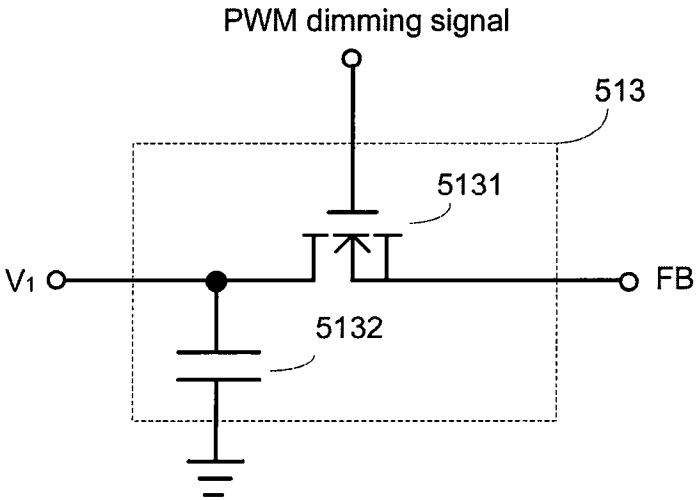
FIG. 5B illustrates a hold-on circuit according to an embodiment of the present technology.

FIG. 5B illustrates a hold-on circuit 513 according to an embodiment of the present technology. The hold-on circuit 513 comprises a switch 5131 and a capacitor 5132. The switch 5131 may comprise a MOSFET device though other types of switching devices may also be used. The input end or the source of the switch 5131 is electrically coupled to the feedback signal FB, the control end or the gate is electrically coupled to the PWM dimming signal and the output end or the drain of the MOSFET is electrically coupled to the capacitor 5132 for delivering a hold-on signal $V_1$. The other end of the capacitor 5132 is electrically coupled to the secondary side ground.

During operation, when the PWM dimming signal is in logic HIGH, current flows flow the LED string 53 and meanwhile, the switch 5131 is turned on and $V_1=V_{FB}=I_{LED}*R_1$. When the PWM dimming signal is in logic LOW, switch 5131 is turned off and current stops flowing through LED string 53. Meanwhile, for capacitor 5132, the current discharging path is disconnected and the voltage $V_1$ is unchanged. In some embodiments, other types of hold-on circuits may also be adopted.

Referring back to FIG. 5A, the error amplifier 510 produces an error signal COMP by amplifying the difference between the voltage $V_1$ and the reference voltage $V_{REF}$. The PWM signal generator 511 is responsive to the COMP signal, and operable to generate gate drive signal (PWM drive signal) in order to drive the primary side switch. In one embodiment, the COMP signal is compared with a constant frequency triangular or a saw tooth waveform to generate the PWM drive signal. Other PWM signal modulation methods such as double edge modulation, rising edge modulation or falling edge modulation may also be applied. Driven by the PWM drive signal, the primary side switch causes the isolated voltage converter 52 to provide a constant current $I_{OUT}$ to drive the LED string 53. As described in more detail below, the hold-on circuit 513 can maintain the output PWM drive signal to have a continuous waveform.

Figure 6:
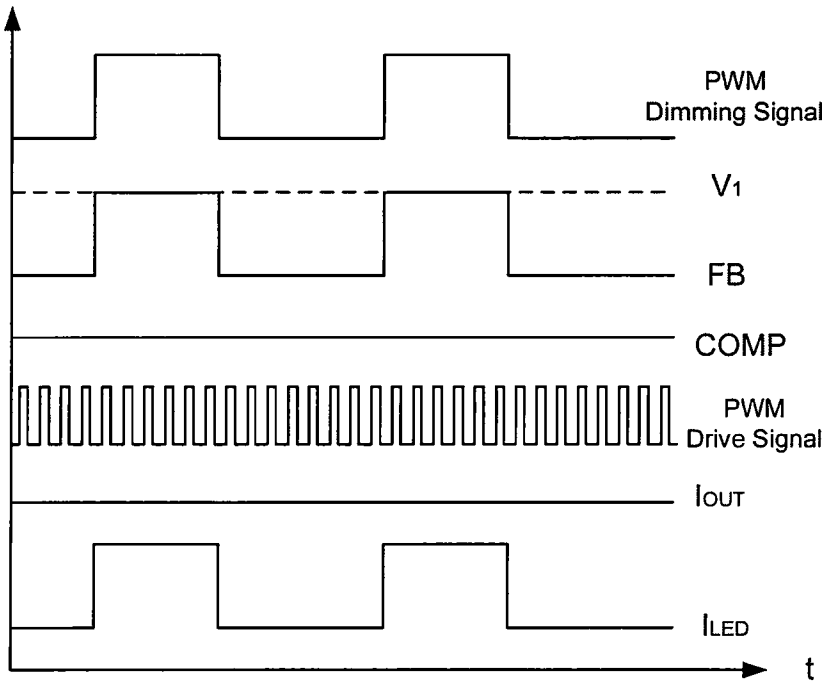
FIG. 6 illustrates a system operational waveform diagram corresponding to the block diagram in FIG. 5, according to an embodiment of the present technology.

FIG. 6 shows an operational waveform diagram corresponding to the dimming and driver system in FIG. 5. As shown in the FIG. 6, the waveform of FB is corresponding to the PWM dimming signal. When the power supply operates in a steady state, the amplified error signal COMP and the output current $I_{OUT}$ of the isolated voltage converter approximate the DC signals.

When the PWM dimming signal is in high level, the current $I_{LED}$ flows through the LED string. Thus the FB signal turns high, V1=$V_{FB}$. If the PWM dimming signal is in low level, the dimming switch K is turned off and the FB signal falls to zero. However V1 is still held in high level as the value at the end of the preceding high-level PWM dimming signal, and consequently the COMP signal is also kept as a DC signal. As a result, the PWM drive signal for driving the primary side switch Q is kept constant and continuous.

Figure 7:
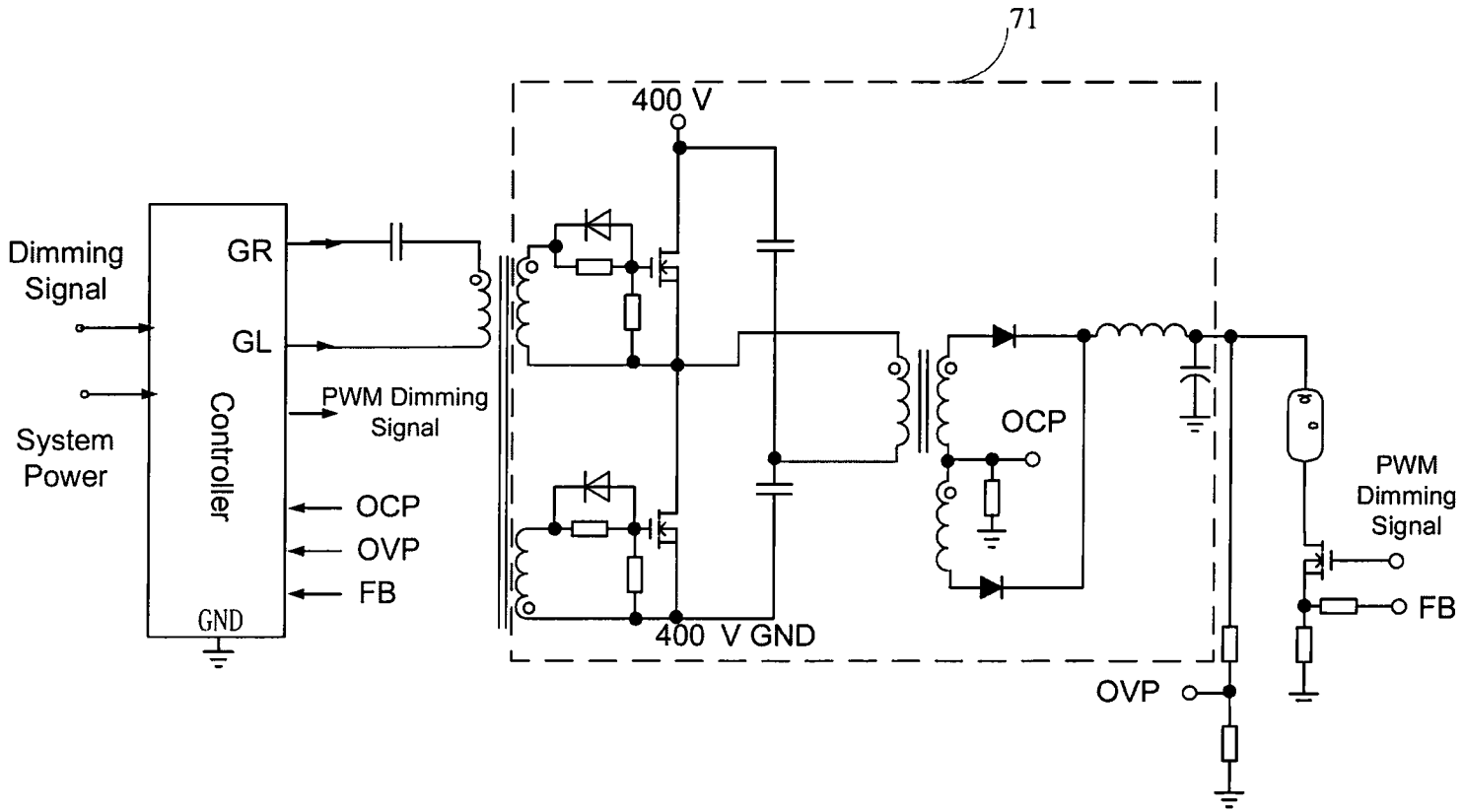
FIG. 7 illustrates a half-bridge isolated voltage converter, according to an embodiment of the present technology.

Even though the isolated voltage converter shown in FIG. 3 is a fly-back voltage converter, other topologies can also be applied for the isolated voltage converter, such as forward, half-bridge, full-bridge or other types of topological structures. As shown in FIG. 7, a half-bridge voltage converter 71 is used in the dimming and driver system. Further, the isolated voltage converter in certain embodiments according to the technology disclosed here may include DC-DC fly-back converter, AC-DC fly-back converter and other types of converter.

Figure 8:
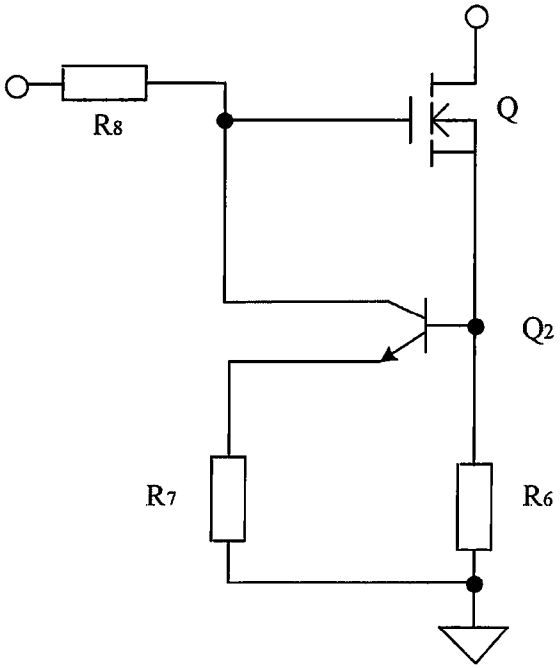
FIG. 8 illustrates a current limit circuit in the primary side for limiting the peak current of the primary side, according to an embodiment of the present technology.

For some embodiments in which the controller is at the secondary side of the isolated voltage converter, a current limit circuit may further be included. FIG. 8 illustrates an embodiment of current limit circuit positioned at the primary side. The current limit circuit is a closed-loop circuit comprising transistor $Q_2$, resistance $R_6$ and $R_7$. In the circuit, the two ends of $R_6$ are coupled to the source of primary side switch Q and the ground respectively. The base of $Q_2$ is coupled to the source of the primary side switch Q; the collector of $Q_2$ is coupled to gate of the primary side switch Q and the emitter of $Q_2$ is coupled to the ground via another resistance $R_7$. A resistor $R_8$ may be coupled between the gate of the primary switch Q and the PWM drive signal. If the primary side current is excess, the base voltage increases to turn $Q_2$ on and the gate voltage of Q is pulled down. Consequently the primary side current falls off. The closed-loop circuit clamps the primary side current in an appropriate range which is determined by the parameters of Q, $Q_2$, $R_6$ and $R_7$ so that over-current protection is achieved.

From the foregoing, it will be appreciated that specific embodiments of the technology have been described herein for purposes of illustration, but that various modifications may be made without deviating from the disclosed technology. Elements of one embodiment may be combined with other embodiments in addition to or in lieu of the elements of the other embodiments. Accordingly, the technology is not limited except as by the appended claims.

We claim:

1. A light emitting diode (LED) driver system, comprising:

a switch-mode voltage converter comprising a primary switch and an output end, wherein the output end is configured to supply a current to an LED;

a dimming module comprising a dimming switch coupled to the LED; and a controller configured to generate a continuous PWM drive signal to control the primary switch of the switch-mode voltage converter, and to generate a PWM dimming signal to control the dimming switch in response to an external dimming signal and a feedback signal from the output end of the switch-mode voltage converter, wherein the controller comprises a hold-on circuit configured to generate an output signal based on the feedback signal and the PWM dimming signal, wherein the output signal is in proportion to the feedback signal when the PWM dimming signal is at a first state, and wherein the output signal remains at the same value as at an end of the first state when the PWM dimming signal is at a second state, and wherein the PWM drive signal is generated in response to the output signal.

2. The LED driver system according to claim 1, wherein the controller further comprises:

a dimming control circuit configured to generate the PWM dimming signal to control the dimming switch configured to control the brightness of the LED;

an error amplifier configured to compare the output signal and a reference signal, wherein the error amplifier is operable to generate an amplified error signal; and a PWM generator configured to be responsive to the amplified error signal, wherein the PWM generator is operable to generate the continuous PWM drive signal to control the primary switch.

3. The LED driver system according to claim 2, wherein the hold-on circuit comprises:

a switch having an input end, a control end and an output end, wherein the input end is electrically coupled to the feedback signal, the control end is electrically coupled to the PWM dimming signal, and the output end is electrically coupled to deliver the output signal; and a capacitor having a first end and a second end, wherein the first end is electrically coupled to the output end of the third switch, and the second end is electrically coupled to ground.

4. The LED driver system according to claim 1, wherein the feedback signal is in proportion to a current flowing through the LED.

5. The LED driver system according to claim 1, wherein the primary switch and the dimming switch are MOSFET devices.

6. The LED driver system according to claim 1, wherein the switch-mode voltage converter is an isolated voltage converter, wherein the isolated voltage converter comprises a primary side and a secondary side, and wherein the controller is positioned at the secondary side.

7. The LED driver system according to claim 6, wherein the isolated voltage converter is a fly-back voltage converter.

8. The LED driver system according to claim 6, wherein the controller further comprises a protection module configured to provide an over-current protection function and a no-load protection function to the isolated voltage converter.

9. The LED driver system according to claim 6, wherein the primary switch is coupled to a current limit circuit, wherein the current limit circuit is configured to limit a primary side peak current flowing through the primary side of the isolated voltage converter.

10. The LED driver system according to claim 9, wherein the current limit circuit comprises:

a first resistor having a first end and a second end, wherein the first end is coupled to a gate terminal of the primary switch, and the second end is coupled to ground on the primary side of the isolated voltage converter;

a second resistor having a first end and a second end, wherein the first end of the second resistor is coupled to the ground on the primary side of the isolated voltage converter;

a transistor having a base, an emitter, and a collector, wherein the base is coupled to a source terminal of the primary switch, the collector is coupled to the gate terminal of the primary switch, and the emitter is coupled to the second end of the second resistor.

* * * * *